United States Patent [19]

Nott

[11] 4,022,032

[45] May 10, 1977

[54] REFRIGERATION SYSTEM

[76] Inventor: Clinton W. Nott, R.D. 1, Box 416, Dallastown, Pa. 17313

[22] Filed: Dec. 16, 1975

[21] Appl. No.: 641,270

[52] U.S. Cl. ..... 62/499; 62/263
[51] Int. Cl.[2] ..... F25B 3/00; F25B 13/00
[58] Field of Search ..... 62/499, 259, 263, 324, 62/352; 165/86

[56] References Cited

UNITED STATES PATENTS

| | | | |
|---|---|---|---|
| 2,559,217 | 7/1951 | Kehoe | 62/238 |
| 2,788,644 | 4/1957 | Gustafsson | 62/325 |
| 2,975,615 | 3/1961 | Atchison | 62/263 |
| 3,055,185 | 9/1962 | Lundstrom | 62/352 |

FOREIGN PATENTS OR APPLICATIONS

| | | | |
|---|---|---|---|
| 616,325 | 7/1935 | Germany | 62/499 |

*Primary Examiner*—Lloyd L. King
*Attorney, Agent, or Firm*—Sherman Levy

[57] ABSTRACT

A refrigeration or air conditioning system or unit is provided that includes revolving or oscillating heat exchangers, wherein the heat exchanger on the refrigeration side acts as an evaporator, while the other acts as a condenser on the outside.

On a predetermined schedule the heat exchangers are rotated or oscillated 180° so as to bring or move the frost laden evaporator outside and a clean condenser inside. Suitable controls are provided for selectively reversing the cycle at the proper time or interval.

2 Claims, 5 Drawing Figures

REFRIGERATION SYSTEM

BACKGROUND OF THE INVENTION

Field of the Invention

The present invention relates to a refrigeration or air conditioner system that includes a pair of equally sized heat exchangers that are selectively moved to different positions so that the heat exchangers can selectively function as an evaporator and a condenser.

Summary of the Invention

A refrigeration system is provided that includes a pair of heat exchangers of equal size that are mounted on a suitable revolving or oscillating structure such as a platform or housing and wherein one of the heat exchangers selectively functions as an evaporator while the other functions as a condenser on the outside, and wherein on a predetermined schedule the support unit is rotated 180° so as to bring the now frost laden evaporator outside, and the clean condenser inside. This provides a means for automatically defrosting the system and unit and in addition, provides other important advantages and features. The unit remains in a particular position until the schedule calls for another defrost cycle wherein the unit rotates back to the starting position.

Individual fan motors are provided for wintertime condensing pressure control, and suitable electrical controls and other accessories are provided as needed or required.

The primary object of the present invention is to provide a refrigeration system that operates in a highly efficient or advatageous manner.

Still another object of the present invention is to provide a refrigeration system that is ruggedly constructed and efficient to use and which is relatively simple and inexpensive to manufacture and operate.

Other objects and advantages will become apparent in the following specification when considered in the light of the attached drawings.

DESCRIPTION OF THE PREFERRED EMBODIMENT

Figure 1:
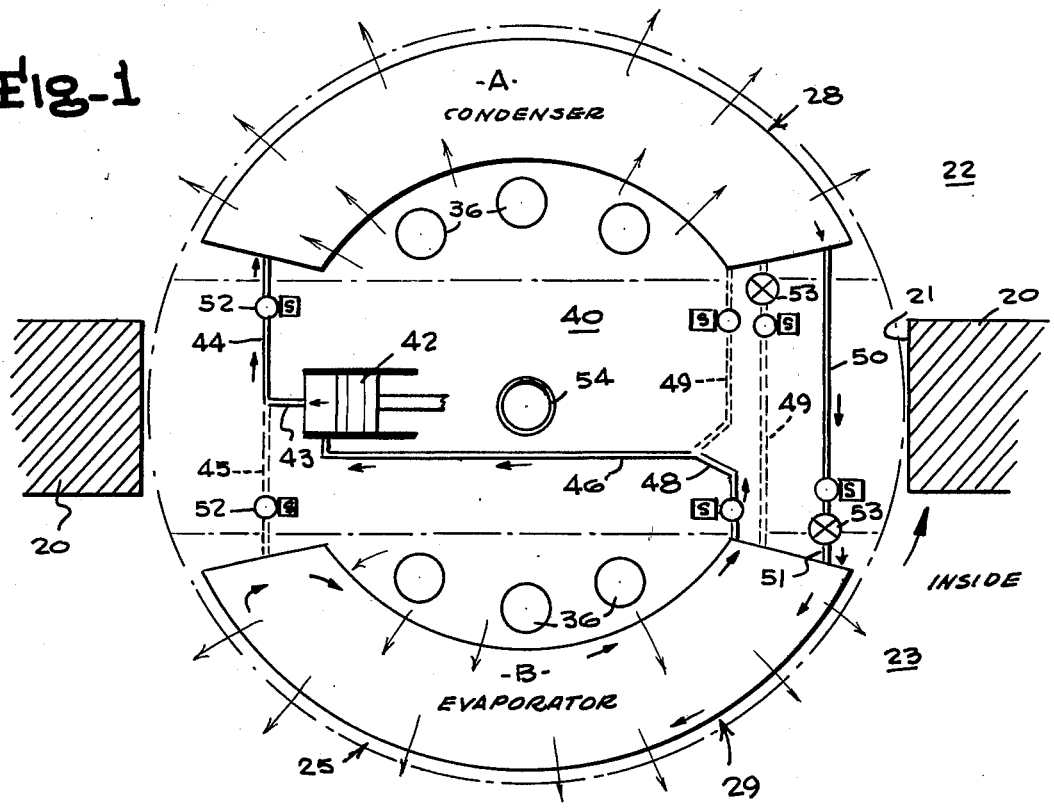
FIG. 1 is a diagrammatic top plan view, with parts broken away and in section illustrating the present invention.

Referring now to the drawings in detail, wherein like reference characters indicate like parts throughout the several figures, there is illustrated a refrigeration system, air conditioning system or the like wherein the numeral 20 indicates a wall that may be vertically disposed, FIG. 1, and the wall 20 has an opening 21 therein. The wall 20 delineates or separates an outside area 22 from the inside area 23, FIG. 2.

Figure 5:
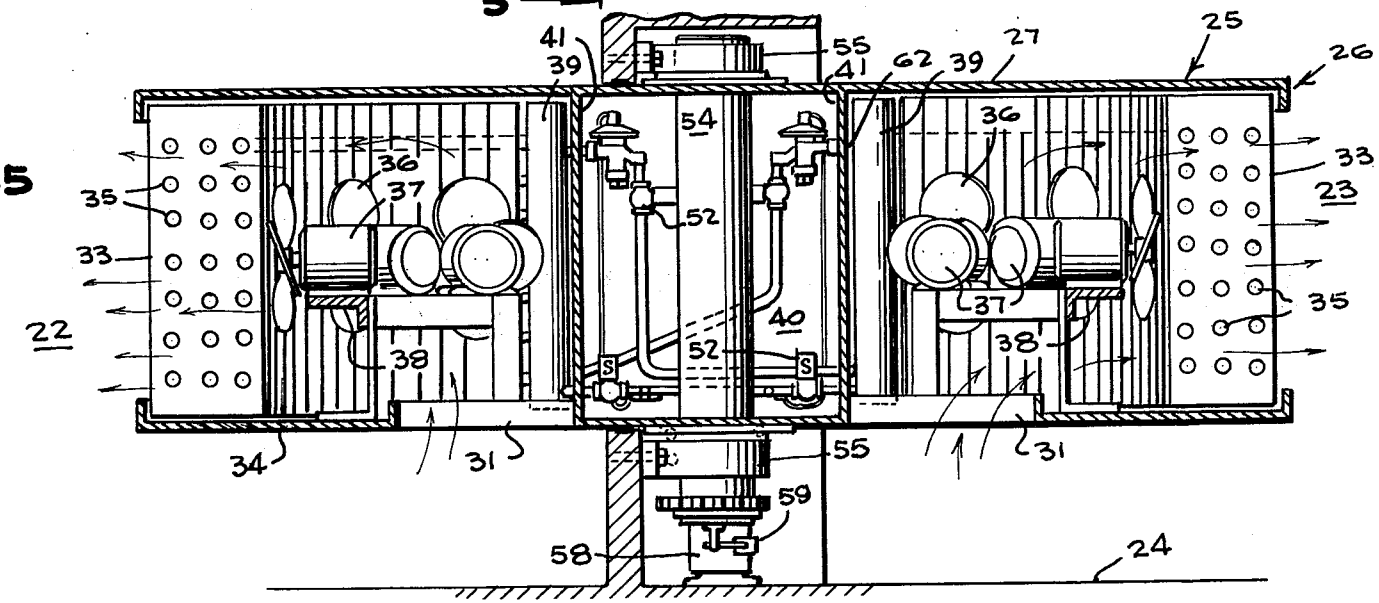
FIG. 5 is a sectional view taken on the line 5—5 of FIG. 4.

The numeral 24 in FIG. 5 indicates a support surface that may be horizontally disposed, and a rotary or oscillating unit 25 is mounted for movement in the opening 21. The unit 25 includes a housing or casing that is indicated generally by the numeral 26, and a cover 27 is detachably mounted on the housing 26.

As shown in the drawings, the unit 25 includes a pair of similar heat exchangers 28 and 29 that selectively and alternately function as an evaporator and condenser. Seal flaps 30 are arranged as shown in FIG. 3 so as to help maintain the cold air within the area or room 23 as the unit 25 rotates or oscillates.

The housing 26 includes a bottom wall 34 that has a pair of spaced apart air inlets 31 therein, FIG. 5. The housing 26 further includes a curved upstanding side wall 32 that has diametrically opposed air outlets 33 therein, FIG. 3. The housing 26 is adapted to be spaced above the support surface 24 as shown in FIG. 5.

Each of the heat exchangers 28 and 29 have the same construction and each includes coils 35, headers 39, fans 36 and motors 37 for driving or operating the fans 36. The motors 37 are suitable supported on members such as the brackets 38.

Figure 3:
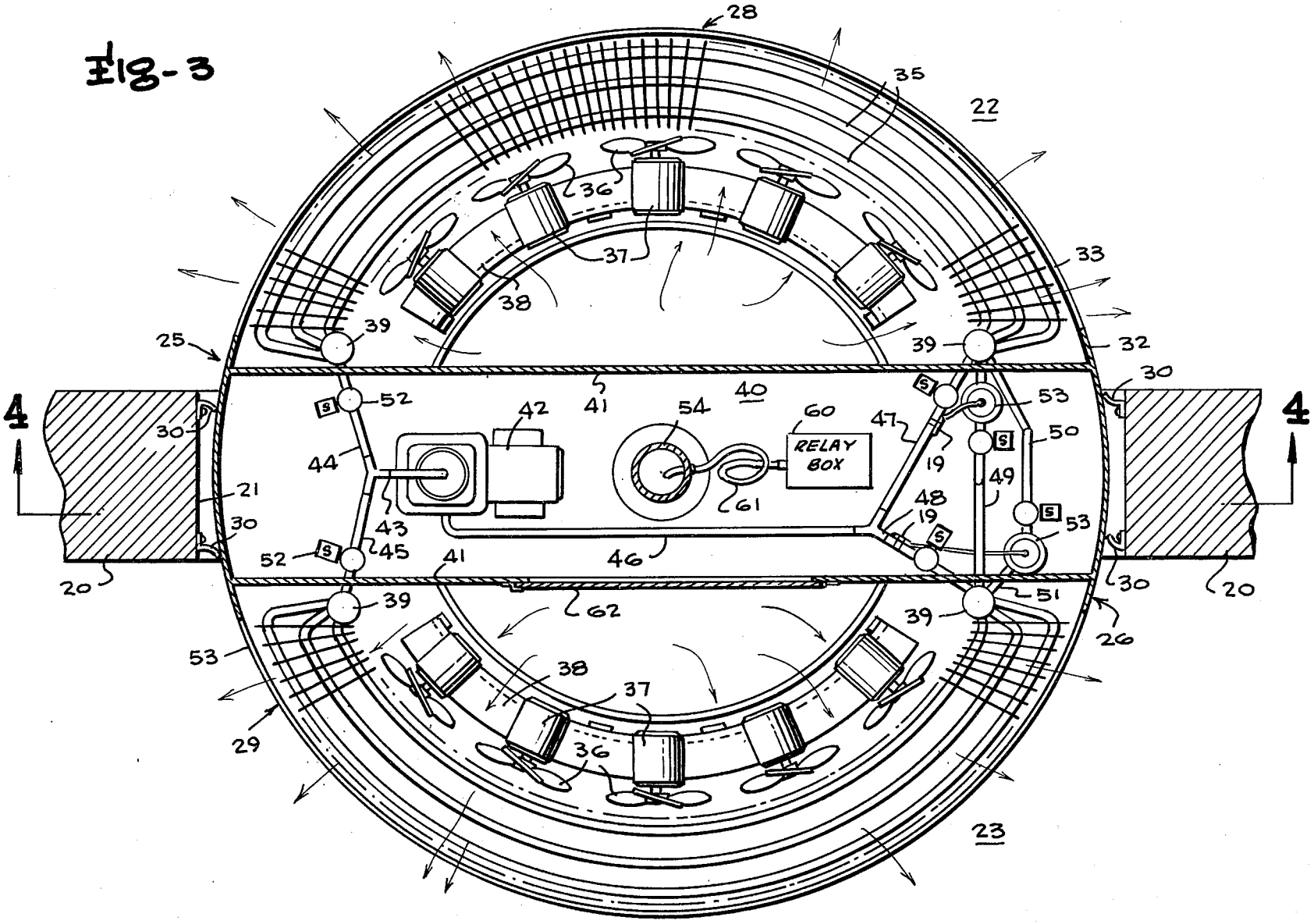
FIG. 3 is an enlarged top plan view of the unit, with the cover removed, and with parts broken away and in section for clarity of illustration.
Figure 4:
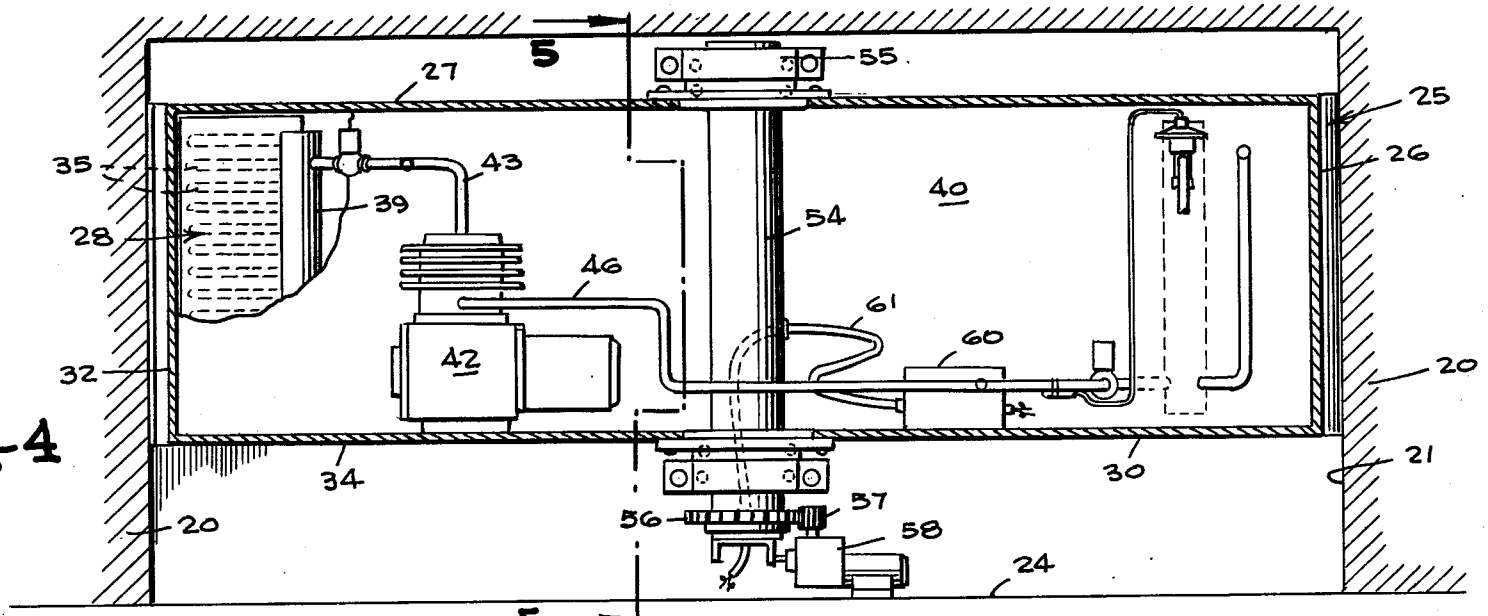
FIG. 4 is a sectional view taken on the line 4—4 of FIG. 3.

The housing 26 is provided with an intermediate section 40 that is defined by spaced parallel wall portions 41, FIG. 3. A compressor 42 is mounted in the intermediate section 40. There is further provided conduit means that operatively connect parts such as the compressor 42 to the headers 39. Such conduits may consist of lines or conduit sections 43 that are connected to the compressor 42, FIG. 3, and lines 44 and 45 are connected to the line 43. A line or conduit 46 is also adapted to be connected to the compressor 42, and branch lines 47 and 48 may be connected to the line 46 by means of a suitable fitting. There is also provided other conduits 49, 50 and 51 for the passage therethrough of a suitable refrigerant. Solenoid valves 52 are operatively connected to certain of the conduits, and expansion valves 53 are also connected to certain of the conduits along with the solenoid valves 52. The numeral 19 indicates thermostatic units that are arranged contiguous to certain of the conduits and these thermostatic elements 19 are operatively connected to members such as the expansion valves 53, FIG. 3. There is further provided a means for selectively oscillating or rotating the housing 26, and this means comprises a hollow shaft or column 54 that is rotatably supported in bearings or brackets 55, FIGS. 4 and 5. Means are provided for rotating the shaft 54 as shown in the drawings. The shaft 54 is secured to the housing 26 so that as the shaft 54 is oscillated or rotated, the housing 26 will turn therewith. A gear 56 may be mounted on the lower end of the shaft 54 and a gear member 57 has its teeth arranged in meshing engagement with gear 56 and the gear member 57 is driven by a motor such as an electric motor 58. The numeral 59 indicates a switch for selectively operating the motor 58 so that motor 58 will function in the desired manner for the stop, reverse, and time cycle.

Other accessories may be provided such as the relay unit 60 shown in FIG. 3 which can have an electrical conductor 61 connected thereto and the conductor 61 is adapted to extend into the hollow shaft 54 in order to electrically connect the parts in the electrical circuit in the desired manner.

The numeral 62 indicates an access door or opening that can be used for gaining access to the space or section 40 as, for example, when it is desired to work on any of the parts therein.

From the foregoing, it will be seen that there has been provided a refrigeration system or air conditioning system and in use with the parts arranged as shown in the drawings, it will be seen that there has been provided an oscillating or rotating unit 25 that has a pair of similar heat exchangers 28 and 29. With the parts arranged as shown in FIG. 1, for example, the heat exchager 28 functions as a condenser and the heat exchanger 29 functions as an evaporator. When the parts are rotated or oscillated from the position shown in FIG. 1 to a position such as that shown in FIG. 2, the heat exchanger 29 acts as the condenser and the heat exchanger 28 acts or functions as the evaporator. This oscillation or rotation is accomplished automatically at periodic predetermined intervals so that various advantages are accomplished. For example, it is not necessary to defrost the unit since by having the evaporator and condenser move to interchangeable positions at periodic intervals, the defrosting will take place automatically, and when the defrosting is taking place, a fresh evaporator is available to provide cooling for the interior or inside area 23, while the outside area 22 has the condenser 28 or 29 postioned therein.

The intermediate section 40 of the unit 25 has the usual or conventional compressor 42 mounted therein and suitable accessories such as conduits are connected to the compressor 42 as well as to the headers 39 of the condenser and evaporator. The conduits or lines have solenoid valves 32 and expansion valves 53 connected thereto and these solenoid valves and expansion valves are automatically opened and closed at the proper interval so that the flow or passage of refrigerant through the system will be controlled in the proper manner in order to permit the condenser and evaporator to function as required or desired. Similarly the fans 36 are electrically connected into the circuit by suitable conductors or wires so that these fans will function to cause inlet air to be selectively drawn up through the openings 31 and blown or discharged out past the coils 35 through the outlet openings 33 in the rotary housing 26 as shown in FIG. 5.

The parts can be made of any suitable material in different shapes or sizes as desired or required.

With the parts arranged as shown in FIG. 3, for example, the inside area 23 will be cold, that is , compared or contrasted to the outside area 22. The seal flaps 30 function to help maintain an airtight mounting for the rotary housing in the opening 21 of the wall 20.

It is to be understood that various controls or accessories can be provided as needed in order to assure that the parts will be automatically operated in the proper sequence. Likewise, it is to be understood that the present invention has various applications wherever cooling and refrigeration are used or needed and the present invention, for example, can be used as a refrigeration unit, air conditioning unit or the like.

It will be seen that in accordance with the present invention, there has been provided an apparatus that accomplishes the desired objectives and the following is given as a description of the sequence of operation: Two equally sized heat exchangers are arranged on a revolving platform or member and one heat exchanger 29 on the refrigeration side acts as an evaporator and the other unit 28 acts as a condenser on the outside. On a predetermined schedule, the platform or housing is rotated 180° bringing the now frost laden evaporator outside and the clean condenser inside so that, for example, the parts move from a position such as that shown in FIG. 1 to a position such as that shown in FIG. 2.

The refrigeration cycle is reversed, the hot gas now flows to the exchanger that was a frosted evaporator, this being very rapidly defrosted. At the same time, the inside exchanger is gathering heat from the refrigerated space providing continuing heat for defrosting. At the same time the outside exchanger is defrosting — the refrigeration continues inside with the only delay in the cooling cycle being the time required to rotate the unit. The unit remains in this position until the schedule calls for another defrost when it rotates back to the starting position.

Individual fan motors such as the motors 37 provide for wintertime condensing pressure control, by means of fan cycling, a no-air flow cycle during unit revolving and continuous evaporator air flow as long as the unit is not revolving.

The electrical service is adapted to enter through the hollow support shaft 54 from the bottom entering the cabinet through a hole in the shaft. Rotation would be absorbed by having an appropriate loop in a flex cable.

The electrical controls are adapted to include high and low press cut out, box thermostat, condenser fan pressure control, oil pressure failure switches, compressor motor starters, control reversing relay, defrost programmers, time clocks and the like.

The fans 36 function as air circulating fans. The shaft 54 is suitably supported by bearings, brackets and the like. When the numeral 20 indicates a building wall, the area on the inside of the building is indicated by the numeral 23 and the area on the outside of the building is indicated by the numeral 22. A suitable control panel and other accessories can be used or provided where needed.

The present invention is thus a new system of providing efficiency for refrigeration and wherein the present invention can be used for various different kinds of units so as to assure that such units will have a much greater capacity.

The present invention can be used with various types of equipment such as refrigeration in a house as well as for commercial installations, and it can also be used for other installations such as walk-in food refrigeration units. It will eliminate the necessity of using electrical defrosting devices. With the present invention, no heat will be added to the room, since the evaporator and condenser will automatically reverse their positions. The unit can be built in a wall and will rotate and in a very short period of time, the condenser and evaporator will interchange their positions. The efficiency of a unit using the present invention will be much higher than existing refrigeration systems presently in use. The unit can be made for one or two stages or the like as desired.

With the present invention, continuous refrigeration or air conditioning can be accomplished and as is well known, a refrigerant acts as a transport medium to move heat from the evaporator to the condenser where it is given off to the ambient air. The change of state from liquid to vapor and back to liquid allows the refrigerant to absorb and discharge large quantities of heat efficiently.

Various types of control devices can be used; for example, the thermostatic expansion valves control the feed of liquid refrigerant to the evaporator and by means of an orifice reduce the pressure of the refrigerant to the evporation or low side pressure. The reduction of pressure on the liquid refrigerant causes it to boil or vaporize. The expansion valve regulates the flow through the evaporator as necessary to maintain a preset temperature difference or superheat between the evvaporating refrigerant and the vapor leaving the evaporator.

Figure 2:
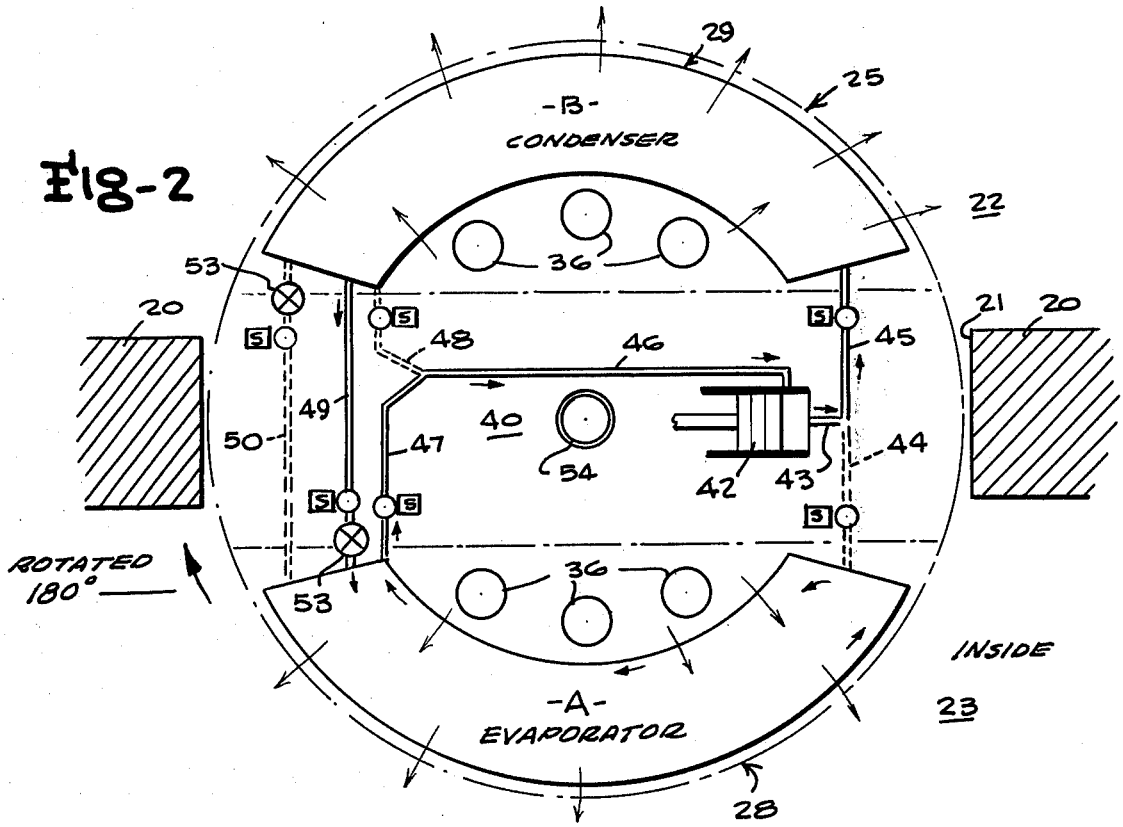
FIG. 2 is a view generally similar to FIG. 1 but showing the parts rotated or oscillated 180°.

The refrigerant vapor leaving the evaporator travels through the suction line to the compressor inlet. In FIGS. 1 and 2, the conduits or lines illustrated in solid lines are shown or illustrated in open position, whereas the conduits illustrated in broken or dotted lines are illustrated in closed position due to the selective actuation of the parts such as the solenoid valves. The fans such as the fan 36 serve to circulate the air up through the openings 31 and out past coils such as the coil 35 and then out through the openings 33.

Also, when the refrigerant gas is compressed in the compressor cylinder, the pressure is increased and the volume is decreased.

Additional embodiments of the invention in this specification will occur to others and, therefore, it is intended that the scope of the invention be limited only by the appended claims and not by the embodiments described hereinabove. Accordingly, reference should be made to the following claims in determining the full scope of the invention.

What is claimed is:

1. In refrigeration, air conditioning systems and the like, a wall having an opening therein, said wall having on opposite sides thereof an outside area and an inside area, a support surface, a rotary unit above said support surface and said rotary unit including a housing movably mounted in the opening in said wall, seal flaps contiguous to said unit, said housing including a pair of similar heat exchangers that selectively provide and define a condenser and an evaporator, said housing having a flat bottom wall spaced from said support surface, and said bottom wall including spaced apart air inlets that are arranged at the lower portion of said heat exchangers, said housing further including a curved side wall that has diammetrically opposed air outlets therein, a cover detachably mounted on said housing, each of said heat exchangers including coils and headers and motor operated fans, said housing including an intermediate section defined by spaced parallel wall portions, a compressor mounted in said intermediate section, conduits operatively connecting said compressor and heat exchangers together, solenoid valves and expansion valves operatively connected to said conduits, and means for oscillating and moving said unit.

2. The structure as defined in claim 1 wherein said last named means comprises a hollow shaft operatively connected to said housing, and a motor operatively connected to said shaft for turning said shaft to move said housing whereby the evaporator and condenser selectively assume interchangeable positions.

* * * * *